US006561475B1

(12) United States Patent
Chuang

(10) Patent No.: US 6,561,475 B1
(45) Date of Patent: May 13, 2003

(54) STRUCTURE FOR LOCATING CURTAIN TRAVERSE ROD

(76) Inventor: Lung-Tang Chuang, P.O. Box 453, Taichung (TW)

( * ) Notice: Subject to any disclaimer, the term of this patent is extended or adjusted under 35 U.S.C. 154(b) by 0 days.

(21) Appl. No.: 10/042,362

(22) Filed: Jan. 11, 2002

(51) Int. Cl.[7] ..... A47H 1/10
(52) U.S. Cl. ..... 248/264; 160/330
(58) Field of Search ..... 248/251, 254, 248/261, 262; 160/330, 345

(56) References Cited

U.S. PATENT DOCUMENTS 2,913,212 A * 11/1959 Bell ..... 248/262
3,734,440 A * 5/1973 Hoare ..... 248/265
4,662,596 A * 5/1987 Haarer ..... 248/251
4,747,182 A * 5/1988 Darner ..... 16/87.4 R
4,785,866 A * 11/1988 Darner ..... 160/345
4,785,867 A * 11/1988 Darner ..... 160/345
4,938,443 A * 7/1990 Rowe ..... 248/251
5,143,336 A * 9/1992 McMichael ..... 248/265
5,398,900 A * 3/1995 Schober ..... 248/251
6,322,029 B1 * 11/2001 Sonnenberg et al. ... 248/222.13

* cited by examiner

*Primary Examiner*—Leslie A. Braun
*Assistant Examiner*—Kofi Schulterbrandt

(57) ABSTRACT

A curtain traverse rod is secured to the wall by a locating structure which is formed of a wall bracket and a fastening member. The wall bracket is provided with a locating piece which is in turn provided with an elastic body and a retaining edge. The fastening member is fastening with one of two longitudinal ends of the curtain traverse rod and is provided with an arresting piece corresponding in location to the elastic body of the wall bracket, and with an elastic piece corresponding in location to the retaining edge of the wall bracket. The fastening member is detachably fastened to the wall bracket.

3 Claims, 8 Drawing Sheets

STRUCTURE FOR LOCATING CURTAIN TRAVERSE ROD

BACKGROUND OF THE INVENTION

1. Field of the Invention

The present invention relates generally to a window curtain, and more particularly to a structure for locating a traverse rod of the window curtain.

2. Description of Related Art

As shown in FIG. 1, a curtain traverse rod 10 of the prior art is provided at two longitudinal ends with a fastening piece 11, which is provided with a retaining hole 12, a wall bracket 13, and a locating piece 14 which is fastened to the wall bracket 13. The locating piece 14 is provided with an elastic piece 15, which is provided at the free end thereof with a retaining projection 16 corresponding in location to the retaining hole 12. The elastic piece 15 is further provided with a knob portion 17. The fastening piece 11 is joined with the wall bracket 13 such that the retaining projection 16 is retained in the retaining hole 12 of the fastening piece 11.

As illustrated in FIGS. 2 and 3, when the traverse rod 10 is separated from the wall bracket 13, the knob portion 17 must be pushed upwards with one hand to cause the retaining projection 16 to move out of the retaining hole 12. In the meantime, the traverse rod 10 is pulled out of the wall bracket 13 with other hand. In light of the space limitation, it is difficult to maneuver to push the knob portion 17 with one hand while the traverse rod 10 is being pulled out of the wall bracket 13 with other hand.

BRIEF SUMMARY OF THE INVENTION

The primary objective of the present invention is to provide a locating structure enabling a curtain traverse rod to engage and disengage easily with the wall brackets.

In keeping with the principle of the present invention, the foregoing objective of the present invention is attained by the locating structure comprising a fastening member and a wall bracket. The fastening member is fastened to one of the two longitudinal ends of the curtain traverse rod, whereas the wall bracket is fastened onto the wall where the curtain is located. The fastening member is provided with an arresting piece and an elastic piece. The wall bracket is provided with a locating plate which is in turn provided with an elastic body and a retaining edge. The traverse rod can be easily disengaged with the wall brackets with one hand by which the elastic piece of the fastening member is pushed away from the retaining edge of the locating plate of the wall bracket. In the meantime, the arresting piece of the fastening member is exerted on by the elastic force of the elastic body of the locating plate of the wall bracket, thereby causing the fastening member to be forced out of the locating plate of the wall bracket.

The features and the advantages of the present invention will be more readily understood upon a thoughtful deliberation of the following detailed description of the present invention with reference to the accompanying drawings.

DETAILED DESCRIPTION OF THE INVENTION

Figure 1:
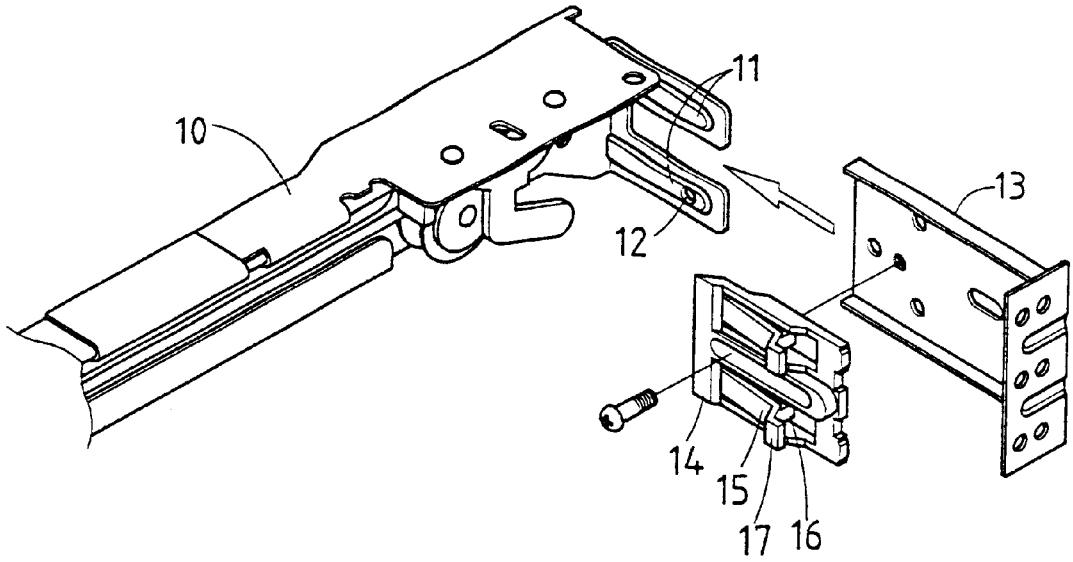
FIG.1 PRIOR ART
FIG. 1 shows an exploded view of a locating structure of a curtain traverse rod of the prior art.
Figure 2:
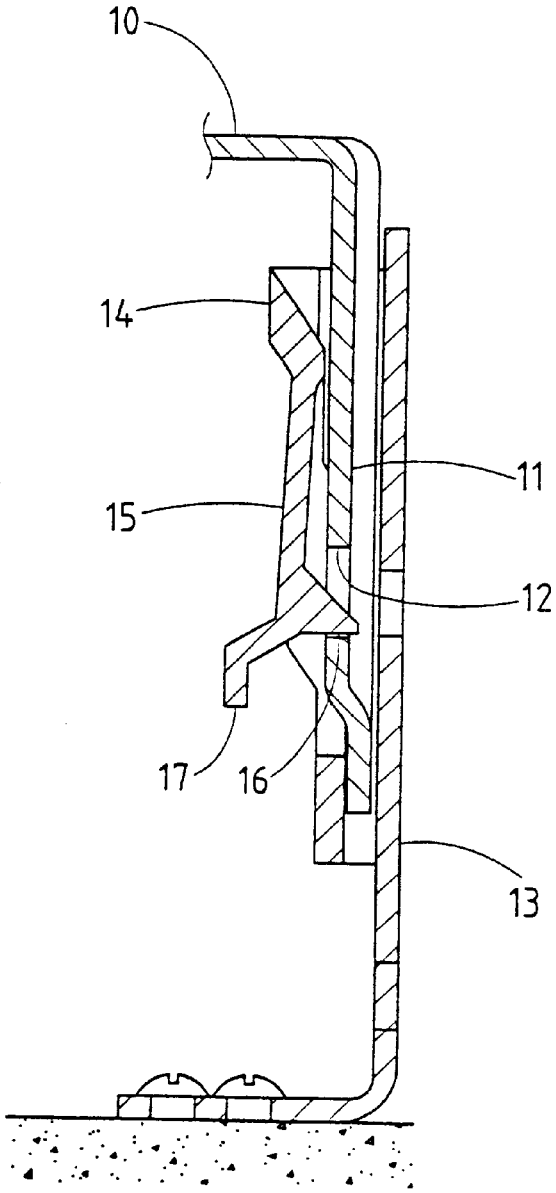
FIG.2 PRIOR ART
FIGS. 2 and 3 are schematic views of the disengagement of the traverse rod with the locating structure of the prior art.
Figure 3:
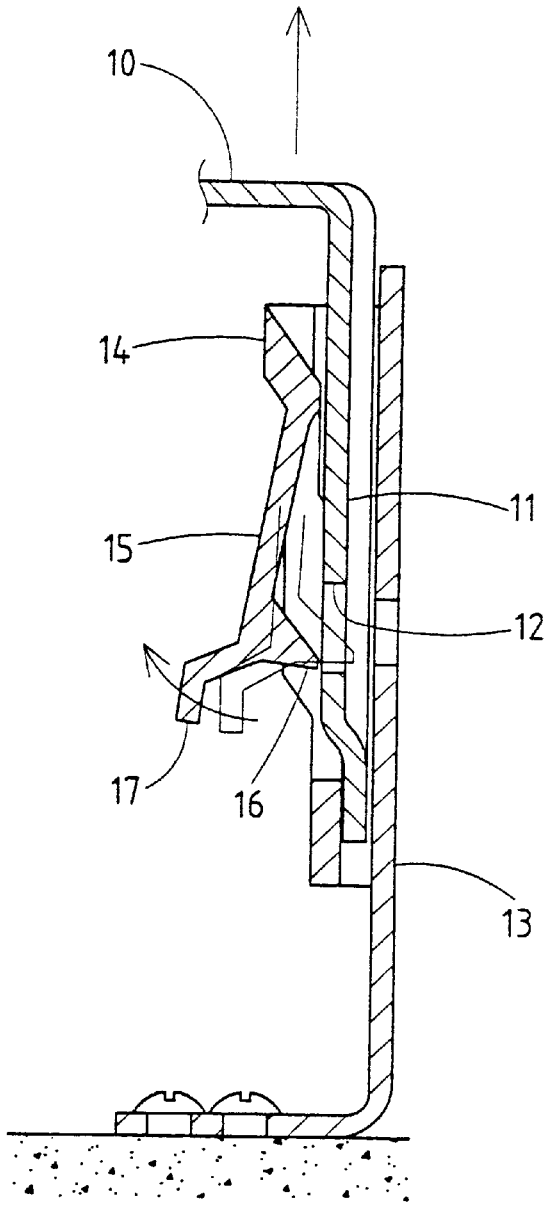
FIG.3 PRIOR ART
Figure 4:
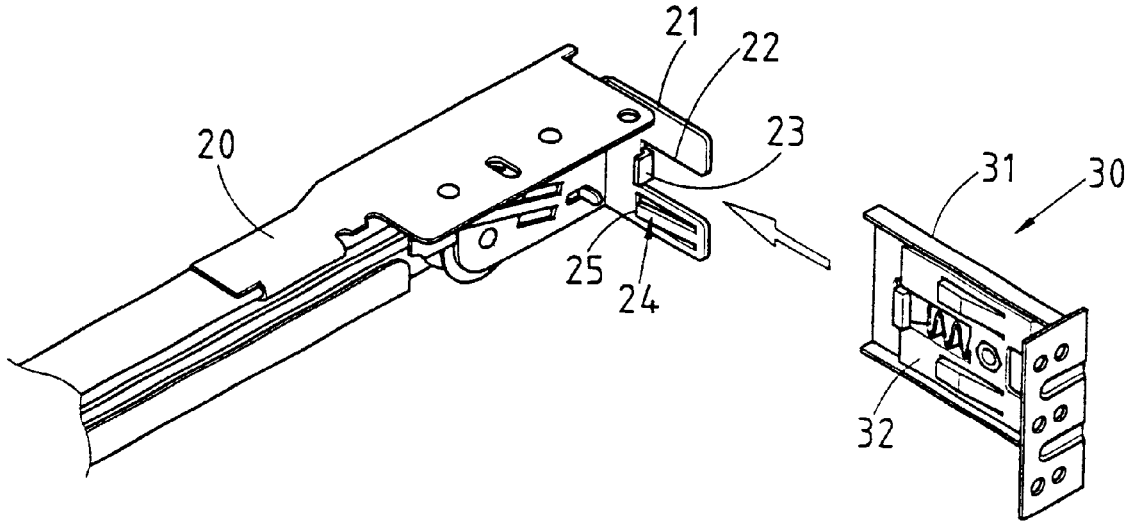
FIG. 4 shows an exploded view of the present invention.
Figure 5:
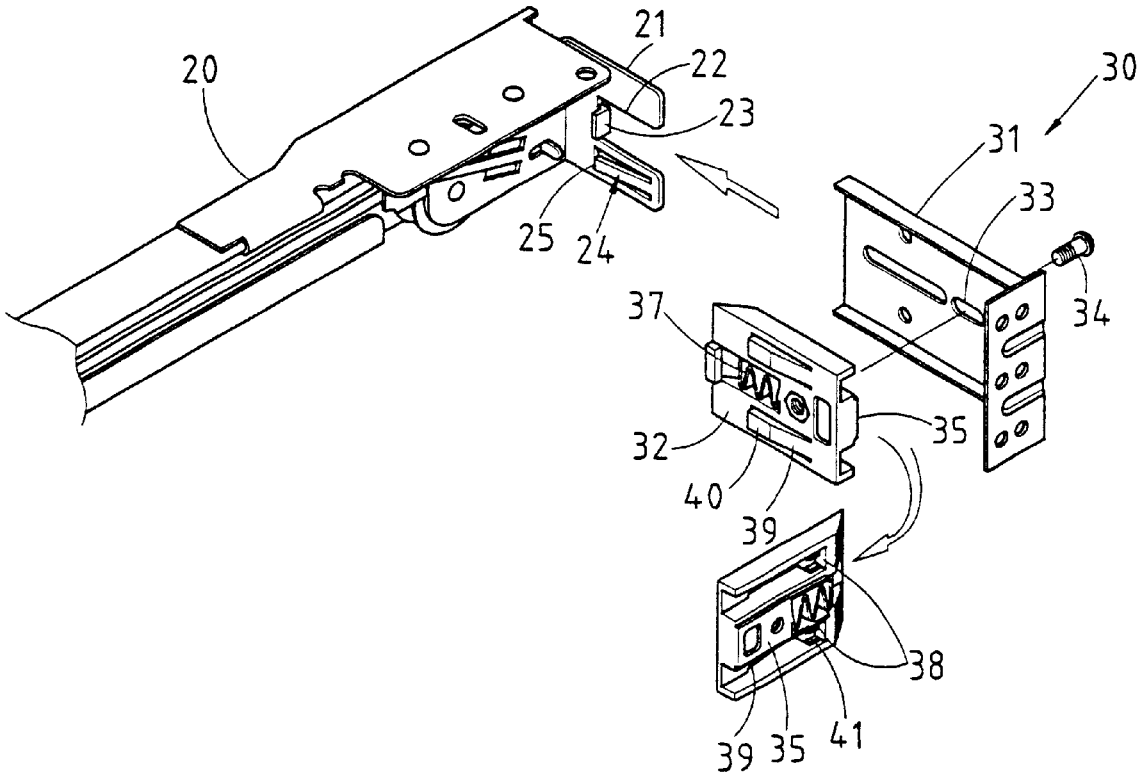
FIG. 5 shows another exploded view of the present invention.
Figure 6:
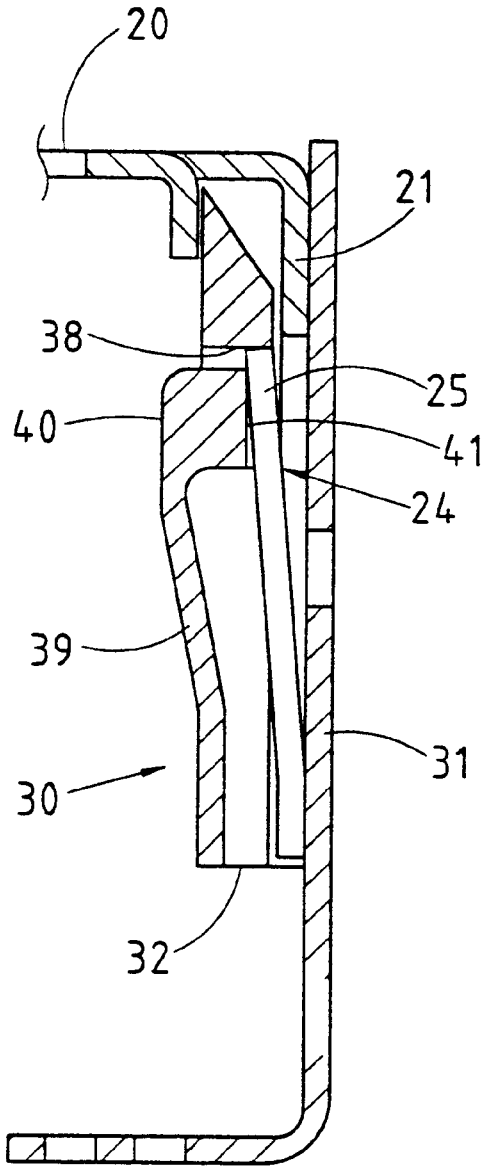
FIG. 6 shows a sectional view of the present invention in combination.

As shown in FIGS. 4–6, a locating structure of the present invention is formed of a fastening member 21 and a wall bracket 30 and is used to locate a curtain traverse rod 20.

The fastening member 21 is fastened to one of two longitudinal ends of the curtain traverse rod 20 and is provided by punching and pressing with a guide slot 22, an arresting piece 23, and an elastic piece 24 with a free end 25 being slanted slightly toward one side of the fastening member 21.

The wall bracket 30 is of an L-shaped construction and is fastened at one end onto the wall. The wall bracket 30 has a fastening plate 31, which is provided with a locating piece 32 and a fastening hole 33 by which the locating piece 32 is fastened to the fastening plate 31 by a fastening bolt 34 via the fastening hole 33. The locating piece 32 is provided with a protruded block 35, an elastic body 37, a retaining edge 38, and an elastic control piece 39. The elastic control piece 39 has a free end 40.

The fastening member 21 of the traverse rod 20 is engaged with the wall bracket 30 such that the protruded block 35 of the locating piece 32 of the wall bracket 30 is received in the guide slot 22 of the fastening member 21, and that the arresting piece 23 of the fastening member 21 is pressed against by the elastic body 37 of the locating piece 32 of the wall bracket 30, and further that the elastic piece 24 of the fastening member 21 is retained by the retaining edge 38 of the locating piece 32 of the wall bracket 30, and still further that one side of the free end 40 of the elastic control piece 39 of the locating piece 32 of the wall bracket 30 is jutted out of the locating piece 32, and still further that other side of the free end 40 of the elastic control piece 39 of the locating piece 32 of the wall bracket 30 is joined with the slanted side of the free end 25 of the elastic piece 24 of the fastening member 21.

Figure 7:
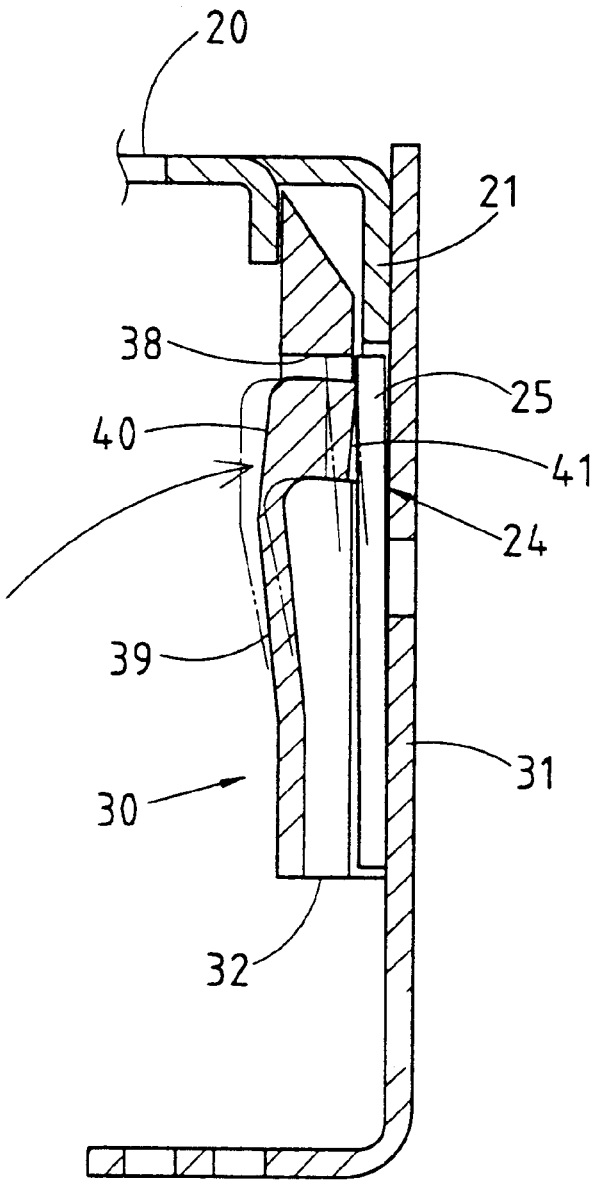
FIG. 7 shows a sectional schematic view of the dismantlement process of the present invention.
Figure 8:
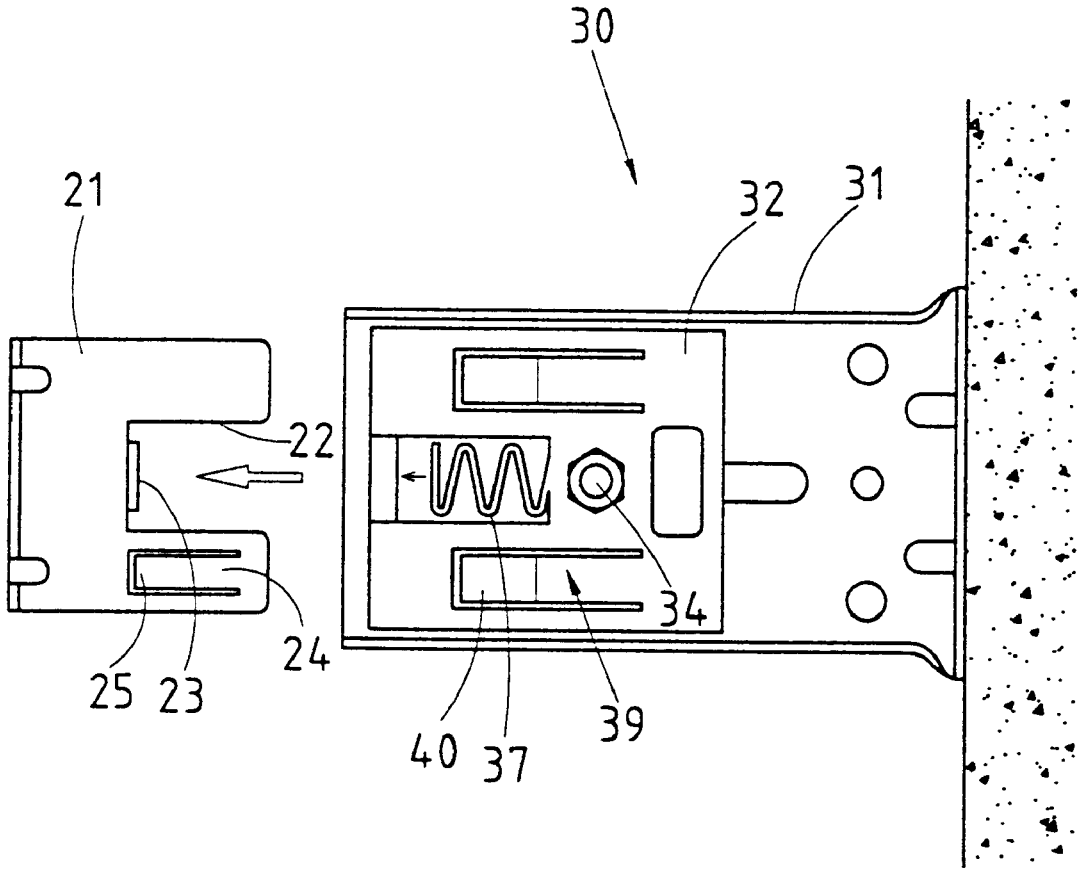
FIG. 8 shows a sectional schematic view of the fastening member of the present invention moving away from the wall bracket.

As illustrated in FIGS. 7 and 8, the fastening member 21 is separated from the wall bracket 30 by using finger to press the elastic control piece 39 so as to push the elastic piece 24 away from the retaining edge 38 of the wall bracket 30. In the meantime, the arresting piece 23 of the fastening member 21 is pushed away by the elastic force of the elastic body 37 of the wall bracket 30, thereby causing the fastening member 21 to be forced out of the locating piece 32 of the wall bracket 30.

The elastic body 37 of the locating piece 32 of the wall bracket 30 is a zigzag spring.

The free end 40 of the elastic control piece 39 of the wall bracket 30 is provided with a press portion 41 to ascertain that the free end 40 is joined with the slanted side of the free end 25 of the elastic piece 24 of the fastening member 21.

The present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A structure for locating a curtain traverse rod, said structure comprising:

a wall bracket fastened at one end onto a wall and provided at other end with a locating piece fastened therewith, said locating piece being provided with a protruded block, an elastic body, a retaining edge, and an elastic control piece having a free end; and a fastening member fastened to one of two longitudinal ends of the curtain traverse rod and provided with a guide slot, an arresting piece, and an elastic piece with a free end being slanted toward one said of said fastening member whereby said fastening member is detachably fastened to said wall bracket such that said guide slot of said fastening member receives said protruded block of said locating piece of said wall bracket, and that said arresting piece of said fastening member is pressed against by said elastic body of said locating piece of said wall bracket, and further that said elastic piece of said fastening member is retained by said retaining edge of said locating piece of said wall bracket, and still further that one side of said free end of said elastic control piece of said locating piece of said wall bracket is jutted out of said locating piece of said wall bracket, and still further that other side of said free end of said elastic control piece is joined with the slanted side of said free end of said fastening member, said fastening member being unfastened with said wall bracket by an external force exerting on said elastic control piece of said wall bracket such that said elastic piece of said fastening member is pushed by said elastic control piece in a direction away from said retaining edge of said wall bracket, and that said arresting piece of said fastening member is pushed away by an elastic force of said elastic body of said wall bracket, thereby causing said fastening member to be forced out of said coating piece of said wall bracket.

2. The structure as defined in claim 1, wherein said elastic body of said locating piece of said wall bracket is a zigzag spring.

3. The structure as defined in claim 1, wherein said free end of said elastic control piece of said wall bracket is provided with a press portion whereby said press portion is intended to make sure that said free end of said elastic control piece is joined with the slanted side of said free end of said elastic piece of said fastening member at the time when said fastening member is fastened with said wall bracket.

* * * * *